US007097719B2

(12) United States Patent
Bray et al.

(10) Patent No.: US 7,097,719 B2
(45) Date of Patent: Aug. 29, 2006

(54) ALUMINUM ALLOY PRODUCT HAVING IMPROVED COMBINATIONS OF PROPERTIES

(75) Inventors: Gary H. Bray, Murrysville, PA (US); John Liu, Murrysville, PA (US); Lynn Eugene Oswald, Bettendorf, IA (US)

(73) Assignee: Alcoa Inc., Pittsburgh, PA (US)

( * ) Notice: Subject to any disclaimer, the term of this patent is extended or adjusted under 35 U.S.C. 154(b) by 77 days.

(21) Appl. No.: 10/716,073

(22) Filed: Nov. 17, 2003

(65) Prior Publication Data

US 2004/0136862 A1 Jul. 15, 2004

Related U.S. Application Data

(60) Provisional application No. 60/426,597, filed on Nov. 15, 2002.

(51) Int. Cl.
*C22C 21/10* (2006.01)

(52) U.S. Cl. ..... 148/417; 420/532

(58) Field of Classification Search ..... 148/417; 420/532

See application file for complete search history.

(56) References Cited

U.S. PATENT DOCUMENTS

| | | | | |
|---|---|---|---|---|
| 5,108,520 A | | 4/1992 | Liu et al. | 148/12.7 R |
| 5,221,377 A | | 6/1993 | Hunt, Jr. et al. | 148/417 |
| 5,277,719 A | * | 1/1994 | Kuhlman et al. | 148/694 |
| 6,027,582 A | * | 2/2000 | Shahani et al. | 148/417 |

* cited by examiner

*Primary Examiner*—George Wyszomierski
*Assistant Examiner*—Janelle Morillo
(74) *Attorney, Agent, or Firm*—Daniel Mark Malony; Eckert Seamans Cherin & Mellott, LLC

(57) ABSTRACT

An alloy product having improved fatigue failure resistance, comprising about, by weight, 7.6 to about 8.4% zinc, about 2.0 to about 2.6% copper, about 1.8 to about 2.3% magnesium, about 0.088 to about 0.25.% Zr, about 0.01 to about 0.09.% Fe, and about 0.01 to about 0.06 w % Si the balance substantially aluminum and incidental elements and impurities The alloy product, suitable for aerospace applications, exhibits improved fatigue failure resistance than its 7055 counterpart of similar size, shape, thickness and temper.

7 Claims, 6 Drawing Sheets
(5 of 6 Drawing Sheet(s) Filed in Color)

Figure 1. Open Hole Fatigue Results (Kt=2.5)
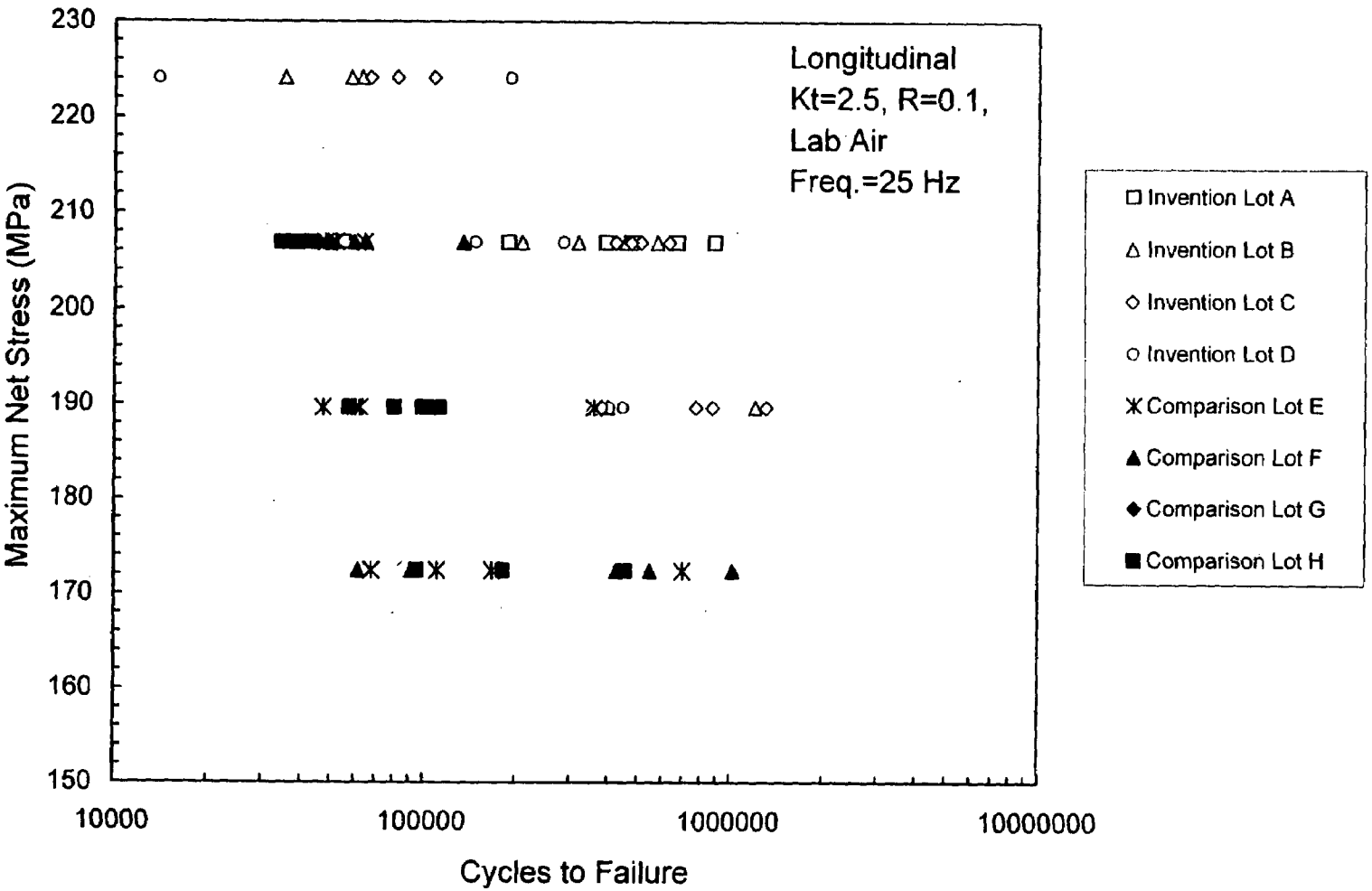

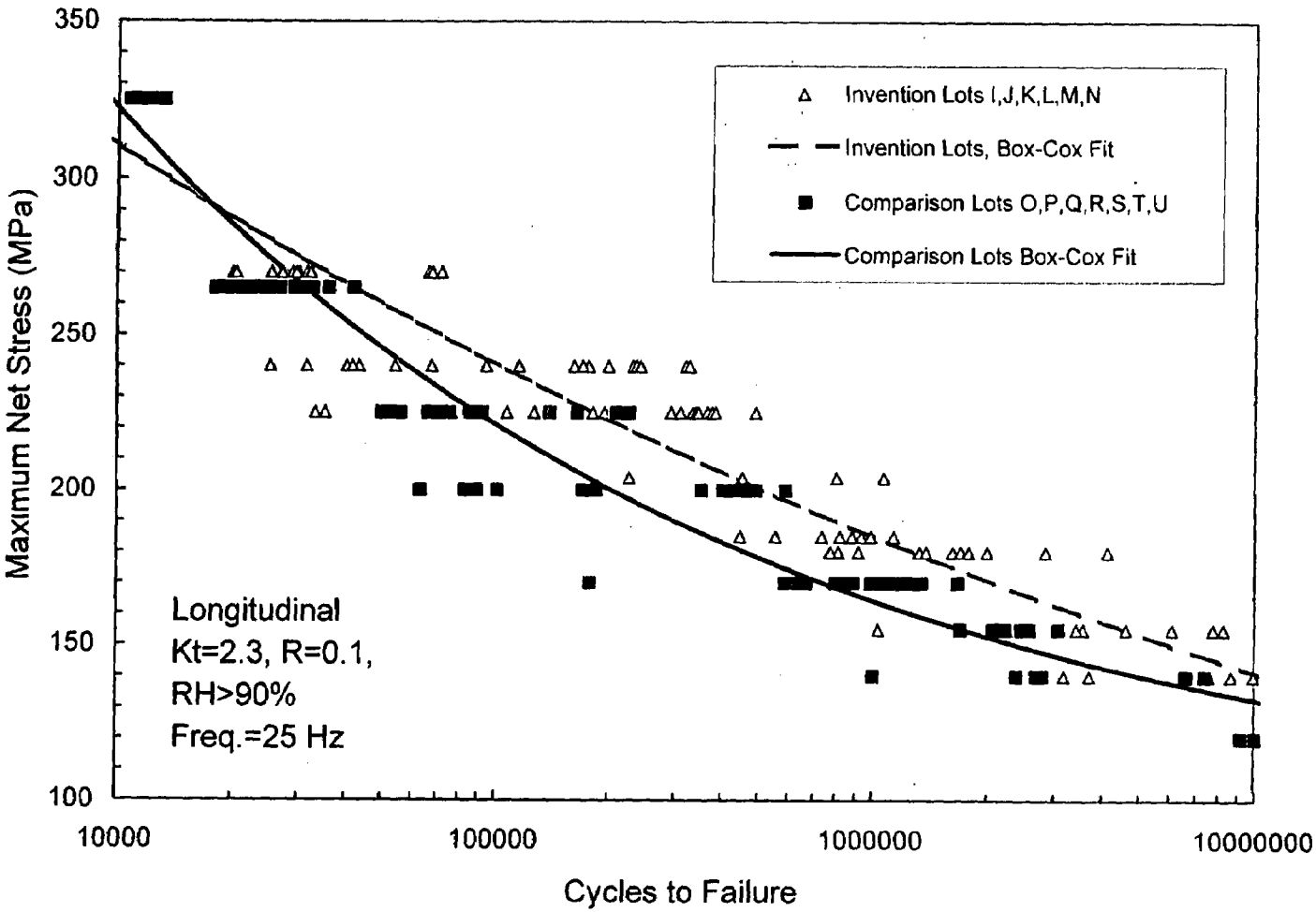
Figure 2. Open Hole Fatigue Results (Kt=2.3)

Figure 3. Schematic of LLT Joint Design (Reverse Double Dogbone)
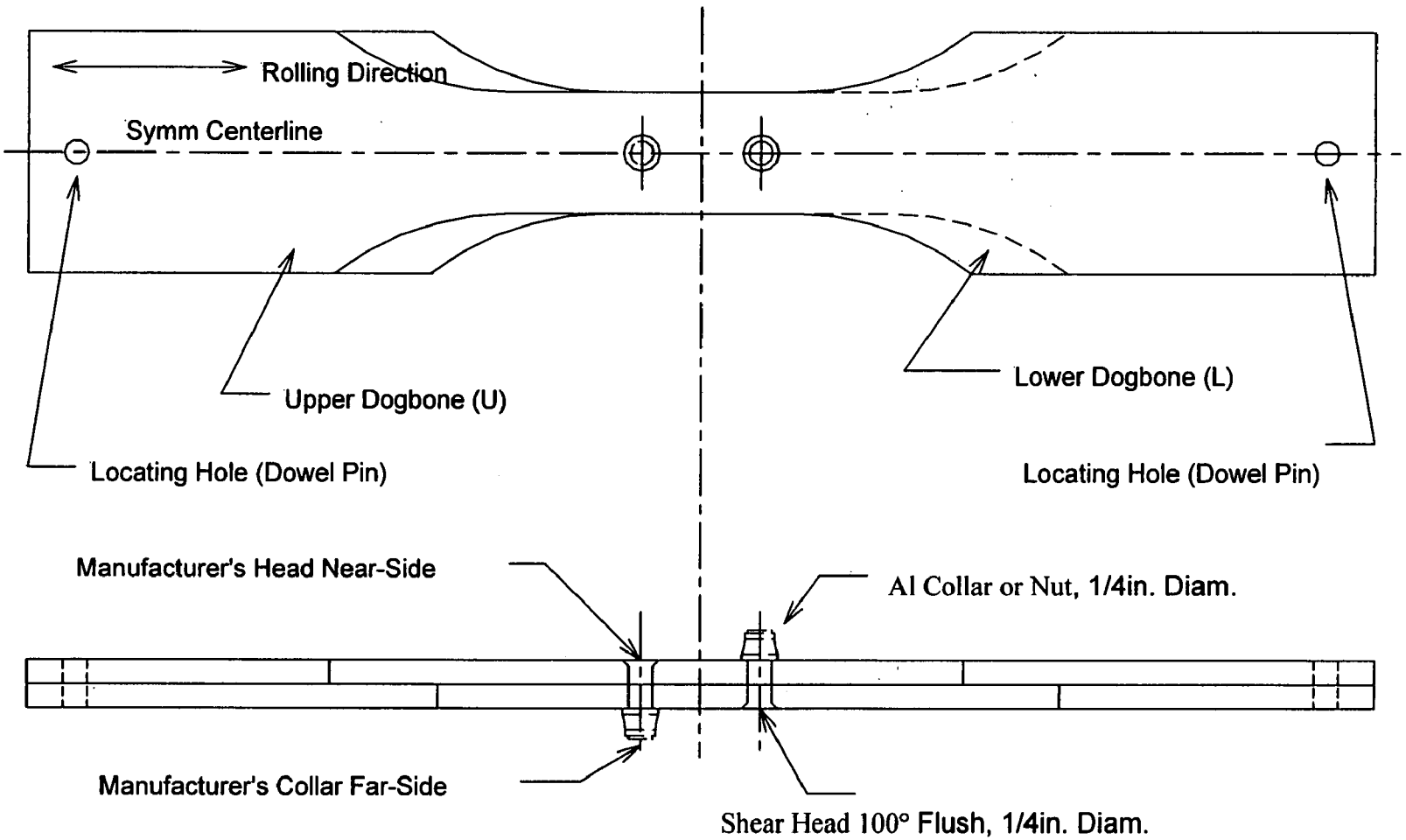

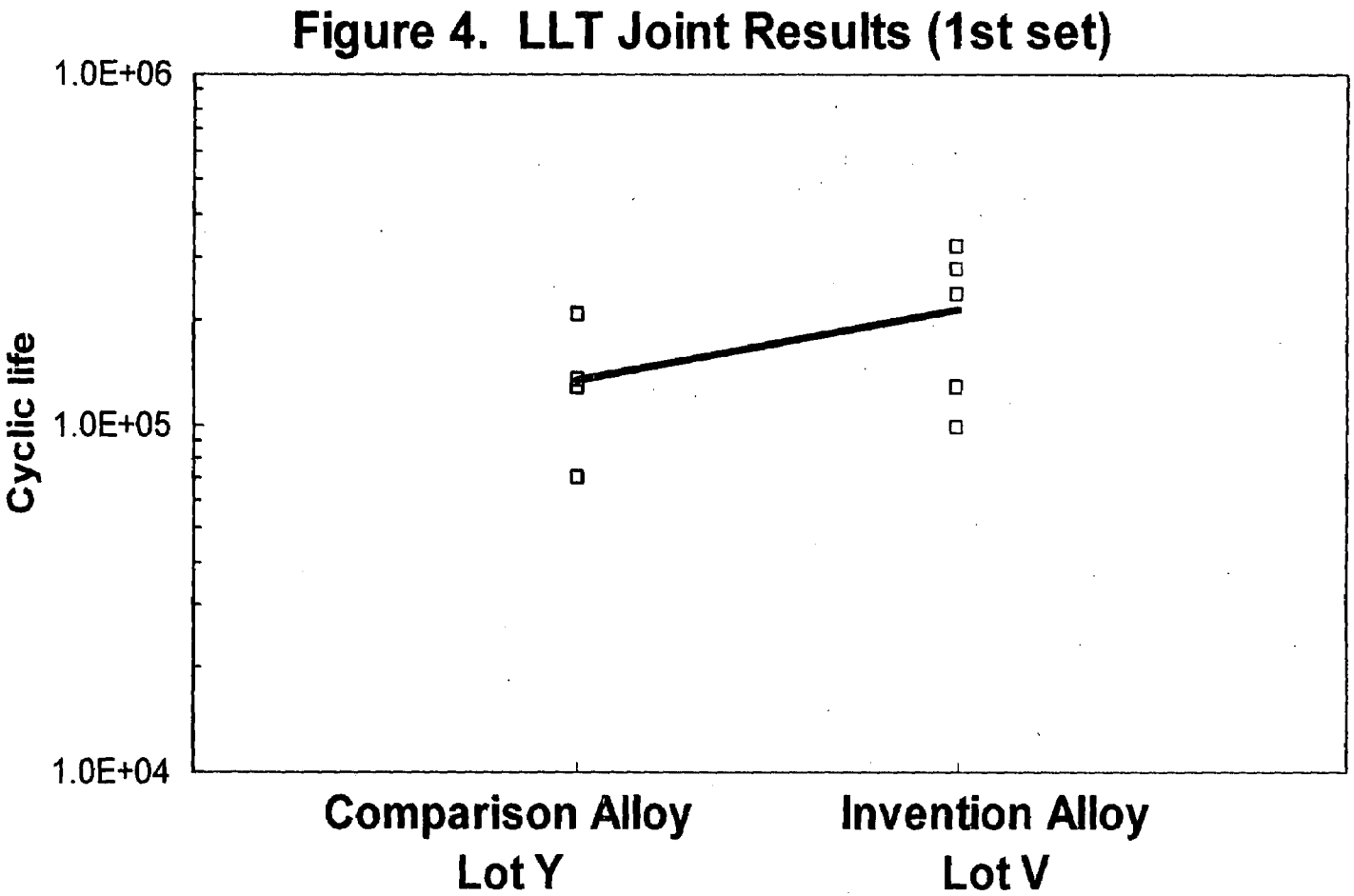
Figure 4. LLT Joint Results (1st set)
1.0E+06
1.0E+05
1.0E+04
Cyclic life
Comparison Alloy
Lot Y
Invention Alloy
Lot V

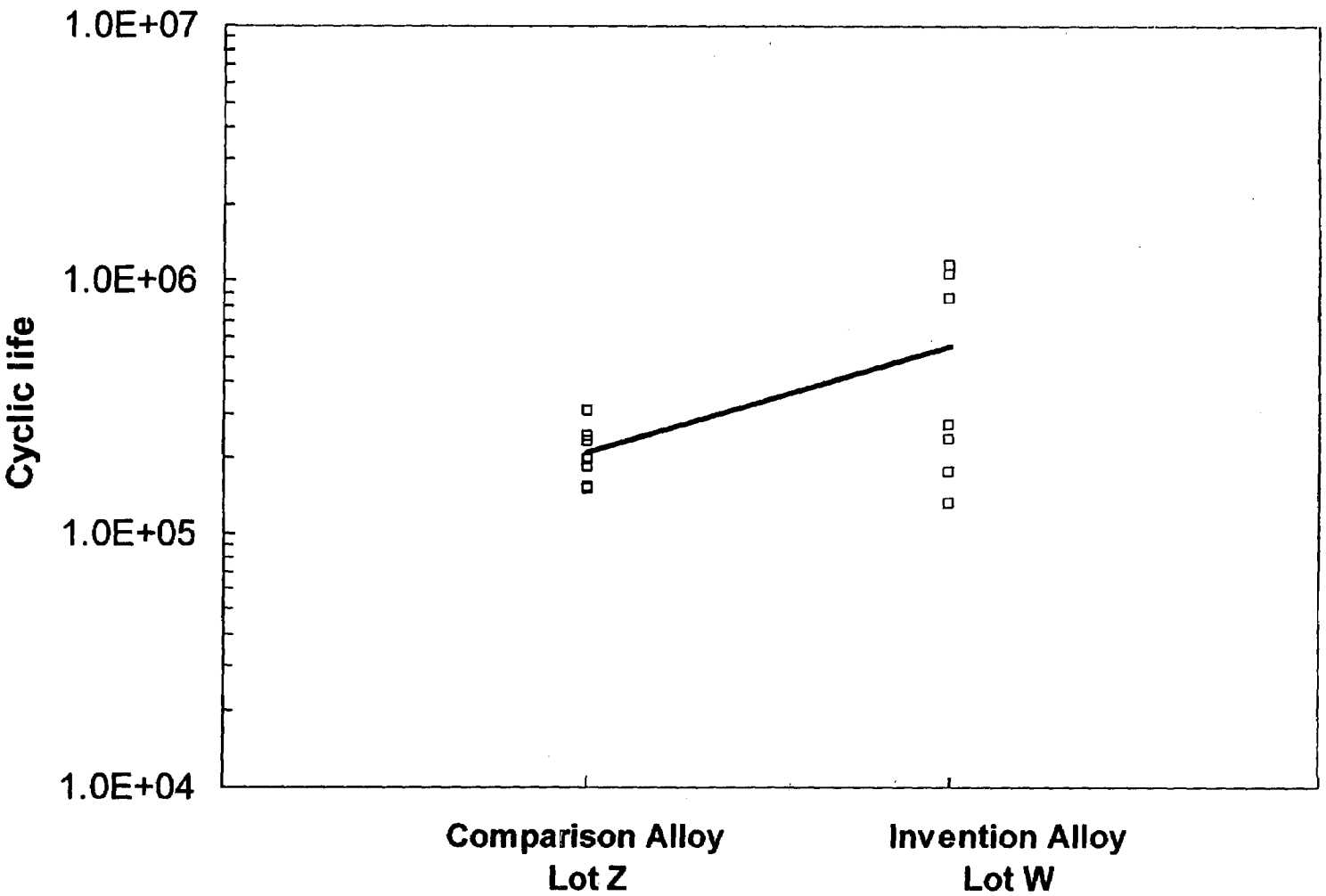
Figure 5. LLT Results (2nd set)

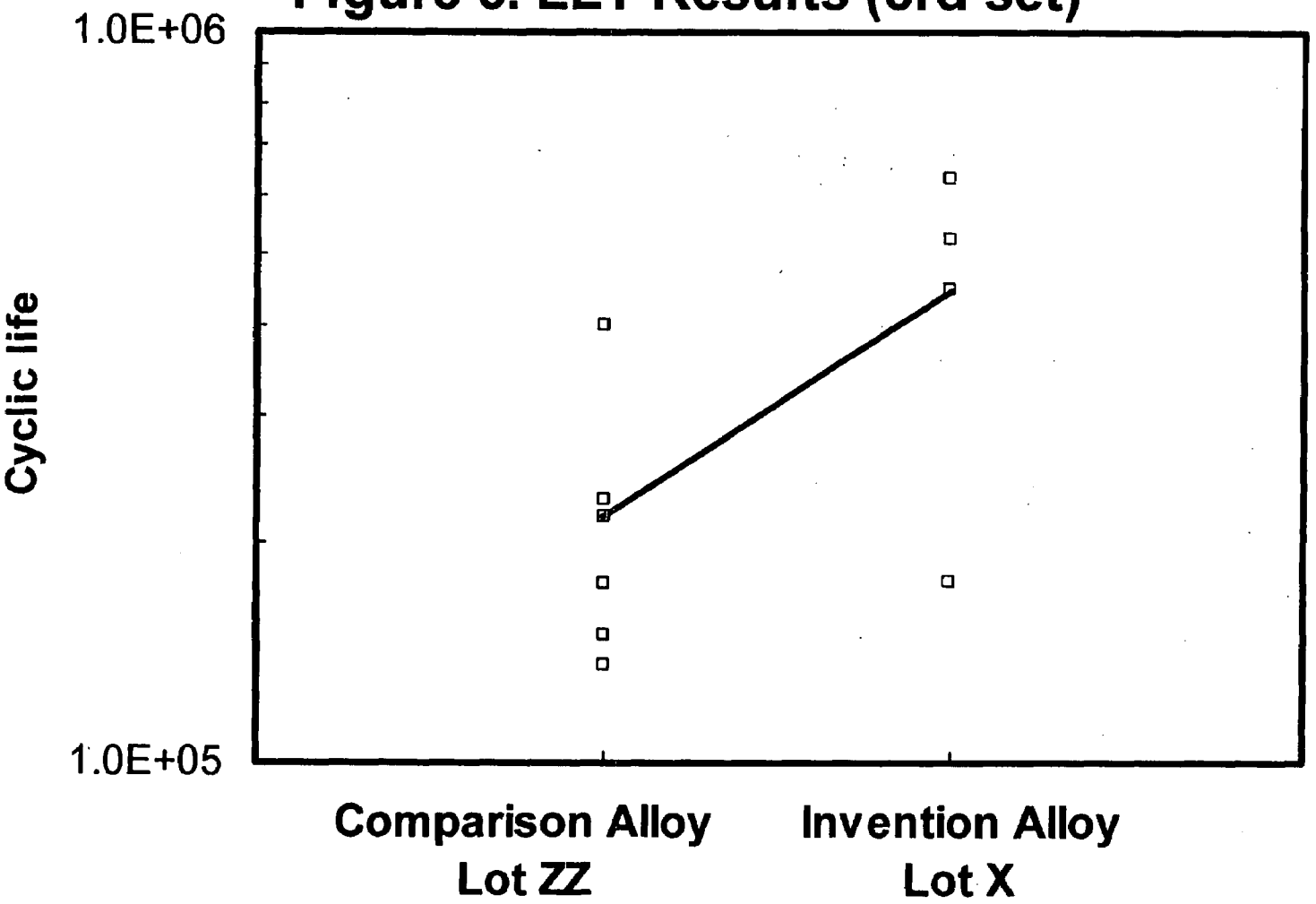
Figure 6. LLT Results (3rd set)
1.0E+06
1.0E+05
Cyclic life
Comparison Alloy
Lot ZZ
Invention Alloy
Lot X

ALUMINUM ALLOY PRODUCT HAVING IMPROVED COMBINATIONS OF PROPERTIES

CROSS REFERENCE TO RELATED APPLICATION

This application claims the benefit of U.S. Provisional Application Ser. No. 60/426,597, filed on Nov. 15, 2002, the disclosure of which is fully incorporated by reference herein.

BACKGROUND OF THE INVENTION

The present invention relates to an aluminum alloy product having improved fatigue failure resistance. This invention further relates to an aluminum-zinc-magnesium-copper alloy having improved fatigue failure resistance over AA 7055.

The financial success of airlines depends upon a number of factors including the cost and performance of their aircraft. Aircraft manufacturers are actively engaged in producing aircraft that efficiently use high performance materials, low cost manufacturing technologies and low cost, advanced design concepts in order to lower the acquisition cost and/or increase the range and weight carrying capacity of their aircraft products.

Another important cost factor for airlines is the aircraft operating cost. Included in the operating cost is the cost of periodic safety inspection of aircraft components for structural damage. An aircraft usually requires two types of inspections: initial inspection and periodic inspection during the operating life of the aircraft. Each type of inspection is very costly, particularly the periodic inspection because the aircraft must be taken out of service for the inspection to be performed. Inspections may require detailed visual inspection and extensive non-destructive testing of exterior and interior structures.

High strength structural components which excel in durability and damage tolerance are highly desired by aircraft manufacturers. Durability and damage tolerance can translate into a long interval between initial inspection and the first periodic inspection and long repeat periodic inspection intervals. Aluminum alloy structural components (such as fastened joints) that exhibit high cycle fatigue performance and fatigue crack growth resistance can translate into long inspection intervals for aircraft.

Thus a need exists for 7000 series alloys that have desirable strength, toughness and corrosion resistance properties and also have improved fatigue failure resistance. A need also exists for aircraft structural parts that exhibit improved fatigue failure resistance.

SUMMARY OF THE INVENTION

A principal object of this invention is to provide aluminum alloys having improved fatigue failure resistance. Another object of this invention is to provide aluminum alloy products having improved fatigue failure resistance. Another object is to provide an improved Al—Zn—Mg—Cu alloy product having improved fatigue failure resistance greater than a similarly-sized and tempered 7055 product. It is another object to provide aerospace structural members, such as plate, sheet, extrusions, forgings, castings and the like, from this improved fatigue resistant alloy. It is another object of this invention to provide aerospace structural members, such as plate, sheet, extrusions, forgings, castings and the like having improved fatigue failure resistance greater than a similarly-sized and tempered 7055 products.

These and other objects of the invention are achieved by an alloy comprised of about 7.6–8.4 wt. % Zn, 2.0–2.6 wt. % Cu, 1.8–2.3 wt. % Mg, 0.08–0.25 wt. % Zr, 0.01–0.09 wt. % Fe, 0.01–0.06 wt. % Si, and the balance substantially aluminum and incidental elements and impurities.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Further features, other objects and advantages of this invention will become clearer from the following detailed description made with reference to the drawings in which:

FIG. 1 is a graph plotting the maximum net stress versus cycles to failure of invention alloys and comparison alloys;

FIG. 2 is a graph plotting maximum net stress versus cycles to failure of invention alloys and comparison alloys;

FIG. 3 is a schematic drawing of a test coupon;

FIG. 4 is a graph depicting the cyclic life of joints made from invention and comparison alloys;

FIG. 5 is a graph depicting the cyclic life of joints made from invention and comparison alloys; and FIG. 6 is a graph depicting the cyclic life of joints made from invention and comparison alloys.

DETAILED DESCRIPTION OF PREFERRED EMBODIMENTS

As used throughout this description of the invention, the following definitions shall apply:

The term "ingot-derived" shall mean solidified from liquid metal by known or subsequently developed casting processes rather than through powder metallurgy or similar techniques. The term expressly includes, but shall not be limited to, direct chill (DC) continuous casting, electromagnetic continuous (EMC) casting and variations thereof.

The term "7XXX" or "7000 Series", when referring to alloys, shall mean structural aluminum alloys containing zinc as their main alloying element, or the ingredient present in largest quantity.

The term "counterpart", when used to compare products made from different 7XXX alloys, shall mean a part or product, e.g. an extrusion, of generally similar section thickness or manufacturing history, or both.

The term "7055" shall mean any alloy currently or subsequently registered in this family or subgroup of 7XXX alloys.

The term "substantially free" means that preferably no quantity of an element is present, it being understood, however, that alloying materials, operating conditions and equipment are not always ideal such that minor amounts of undesirable contaminants or non-added elements may find their way into the invention alloy.

For every numerical range set forth, it should be noted that all numbers within the range, including every fraction or decimal between its stated minimum and maximum, are considered to be designated and disclosed by this description. As such, herein disclosing a preferred elemental range of about 7.6 to 8.4% zinc expressly discloses zinc contents of 7.7, 7.8, 7.9% . . . and so on, up to about 8.4% zinc. Similarly, herein disclosing artificial aging to one or more temperatures between about 300° and 345° F. discloses thermal treatments at 301°, 302° F., . . . 315°, 316° F., . . . and so on, up to the stated maximum.

These and other objects of the invention are achieved by an alloy comprised of about 7.6–8.4 wt. % Zn, 2.0–2.6 wt. % Cu, 1.8–2.3 wt. % Mg, 0.08–0.25 wt. % Zr, 0.01–0.09 wt. % Fe, 0.01–0.06 wt. % Si, and the balance aluminum.

The invention provides an alloy having enhanced fatigue properties. Use of the alloy provides the opportunity for aircraft manufacturers to increase the load carrying capacity and/or increase the initial and repeat inspection intervals associated with aircraft. As compared to the 7055 alloy, the ranges for major alloying elements of the invention alloy, Cu, Mg, Zn and Zr are similar, as shown in Table I.

TABLE I

| | Composition Limits of Standard 7055 Alloy and the Invention Alloy | | | | | |
|---|---|---|---|---|---|---|
| | Si | Fe | Cu | Mg | Zn | Zr |
| Standard 7055 | 0.10 max | 0.15 max | 2.0–2.6 | 1.8–2.3 | 7.6–8.4 | 0.08–0.25 |
| Invention Alloy | 0.01–0.06 | 0.01–0.09 | 2.0–2.6 | 1.8–2.3 | 7.6–8.4 | 0.08–0.25 |

The important compositional differences between the invention alloy and alloy 7055 are the Si and Fe levels. The invention alloy possesses surprising, significantly enhanced fatigue performance associated with Si and Fe compositional changes when compared to alloy 7055. The inventors have discovered that an improvement in the invention alloy fatigue failure resistance is associated with decreasing fatigue initiation by $Mg_2Si$ intermetallic particles. When the Si concentration is maintained below about 0.06%, particularly below about 0.04%, the usually observed $Mg_2Si$ in this alloy system is absent or almost absent, thereby significantly delaying the onset of fatigue failure.

The inventors believe that, the 7000 series alloys undergoes a hierarchy of fatigue failure modes. In order of ease of failure, $Mg_2Si$ particle initiation is easiest, Fe-bearing particle initiation is more difficult and lattice slip is the most difficult. In the invention alloy, which is substantially free of $Mg_2Si$, and in which the Fe-bearing particle concentration is extremely low, the dominant fatigue failure mode would be lattice slip. The lattice slip failure mode then requires higher fatigue stresses or longer fatigue cycles to initiate and propagate fatigue cracks than 7000 series alloys such as 7055 having higher Si and Fe contents.

Products made from the invention alloy, having lower Si and Fe levels than 7055 exhibit substantially better fatigue failure resistance than 7055 products of similar size and temper.

Because of the combinations of properties attainable, the invention alloy is especially well suited for critical aerospace applications, such as wing upper wing stiffened skin panels or members (typically plate and extrusion, but can be integral plate or extrusion), and other high fatigue end uses. Products may be directly cast or formed into useful shapes from this alloy by any forming technique including rolling, forging and extrusion. The resulting sheet, plate, extrusion, forging, rod, bar or the like, may vary greatly in size and shape. For most aerospace applications, plate products made in accordance with this invention may have cross-sectional thicknesses ranging from about 0.3 or 0.35 inch, up to about 1.5, 2 or even 3 or more inches. It should be further understood, however, that the invention alloy may also be made into products having cross-sectional thicknesses even smaller than about 0.3 inch.

The alloy products of this invention are typically ingot-derived and exhibit internal structure features characteristic of ingot derivation. Once an ingot has been cast from the invention composition, it is homogenized by heating to one or more temperatures between about 860° and 920° F. after which it is worked (and sometimes machined) into a desired shape. The product, if desired, should then be solution heat treated by heating to one or more temperatures between about 840° or 850° F. and about 880° or 900° F. to take substantial portions, preferably all or substantially all, of the soluble zinc, magnesium and copper into solution, it being again understood that with physical processes which are not always perfect, probably every last vestige of these main alloying ingredients will not be dissolved during SHT (solutionizing). After heating to elevated temperatures as just described, the product should be rapidly cooled or quenched to complete the solution heat treating procedure. Such cooling is typically accomplished by immersion in a suitably sized tank of cold water, though water sprays and/or air chilling may be used as supplementary or substitute cooling means. After quenching, certain products may need to be cold worked, such as by stretching, so as to relieve internal stresses. A solution heat treated (and quenched) product, with or without cold working, is then considered to be in a precipitation-hardenable condition, or ready for artificial aging according to one of two preferred methods. As used hereinafter, the term "solution heat treat" shall be meant to include quenching unless expressly stated otherwise.

The artificial aging methods for use with the invention alloys are described in detail in U.S. Pat. No. 5,108,520 (Liu) and U.S. Pat. No. 5,221,377 (Hunt) both of which are incorporated herein by reference. In addition, the artificial aging process can also be carried out by one or two step approaches.

The invention products, whether they be plate or extrusions, are also amenable to age forming. The age forming process involves placing the initially flat or straight products into a curved configuration by applying a load using mechanical means or vacuum bags. The subassembly of parts and tools are then placed in such equipment as autoclaves or furnaces to effect an artificial aging process. After the aging process, the product is released from the tools and some reproducible amount of springback usually occurs. The curved configuration actually compensates for the springback so that the final shape is the desired shape. A typical thermal cycle for age forming involves a 10-hour soak at 302° F. followed by a 24-hour soak at 250° F. The temper derived from such a thermal cycle is also known as the T79XX temper according to the nomenclature used by the Aluminum Association.

To some extent, mechanical properties and corrosion characteristics of the invention alloy can be mutually traded by adjusting the aging process, i.e., increased temperature and/or time within limits during artificial aging can provide alloy products with higher corrosion resistance but lower strength. The converse is true—decreased temperature and/or time within limits can provide alloy products with higher strength but with lower corrosion resistance. Hence, other combinations of soak temperatures and times and temperatures which are different from the above described typical thermal cycles are possible depending on the desired combination of mechanical and corrosion characteristics.

The invention alloy provides products suitable for use in large airplanes, such as large commercial passenger and freight aircraft. Such products, themselves, are typically large, typically several feet in length, for instance 5 or 10 or 50 feet up to 100 feet or more. Yet even in these large sizes, the invention products achieve good fatigue resistance properties. Hence, a particular advantage of the invention is sufficiently large size products to be suited to major structure components in aircraft, such as major wing components, wing box components, keel beam components, and the like, and subassemblies such as wing section, fuselage section, tail section (empennage).

Preferred embodiments of this invention possess improved fatigue failure resistance that were not previously attained with high zinc-aluminum alloys. Because such property combinations are achieved with little cost to alloy density, the invention is especially well suited for many critical aerospace applications, including upper wing assemblies and the like.

In order to show the efficacy of improving fatigue resistance in a 7000 series alloy by reducing the Si content of the alloy the following tests were performed. The results are presented herein for purposes of illustration and not limitation.

EXAMPLE 1

Four lots each of the invention alloy and standard 7055 were cast and fabricated into plate. The actual compositions and plate thickness are shown in Table II.

TABLE II

| Alloy | Lot No. | Temper | Thick (mm) | Si | Fe | Cu | Mg | Zn | Zr |
|---|---|---|---|---|---|---|---|---|---|
| Invention | A | T7751 | 31.7 | 0.020 | 0.030 | 2.15 | 1.89 | 8.05 | 0.130 |
| | B | T7751 | 31.7 | 0.019 | 0.032 | 2.17 | 1.93 | 8.08 | 0.120 |
| | C | T7751 | 31.7 | 0.014 | 0.037 | 2.15 | 1.88 | 7.92 | 0.120 |
| | D | T7751 | 31.7 | 0.029 | 0.039 | 2.10 | 1.88 | 7.83 | 0.110 |
| Comparison | E | T7751 | 25.4 | 0.082 | 0.110 | 2.40 | 2.06 | 8.32 | 0.120 |
| Alloy | F | T7751 | 31.7 | 0.073 | 0.100 | 2.40 | 1.96 | 8.16 | 0.110 |
| (Standard | G | T7751 | 31.7 | 0.076 | 0.110 | 2.40 | 1.90 | 7.97 | 0.130 |
| 7055) | H | T7751 | 44.5 | 0.072 | 0.100 | 2.36 | 1.96 | 8.16 | 0.110 |

These plates were solution heat treated, stretched and aged to the T7751 temper in accordance with U.S. Pat. Nos. 5,108,520 and 5,221,377. Fatigue testing was performed to obtain stress-life (S-N or S/N) fatigue curves. Stress-life fatigue tests characterize a material's resistance to fatigue initiation and small crack growth which comprises a major portion of the total fatigue life. Hence, improvements in S-N fatigue properties may enable a component to operate at a higher stress over its design life or operate at the same stress with increased lifetime. The former can translate into significant weight savings by downsizing, while the latter can translate into fewer inspections and lower support costs.

The S-N fatigue data for the invention and the standard 7055 product in FIG. 1 were obtained for a net stress concentration factor, Kt, of 2.5 using double open hole test coupons. The test coupons were 230 mm long by 25.4 mm wide by 3.17 mm thick and had two 4.75 mm in diameter holes, spaced 25.4 mm apart along the coupon length. The test coupons were stressed axially with a stress ratio (min load/max load) of R=0.1. The test frequency was 25 Hz and the test were performed in ambient laboratory air. Those skilled in the art appreciate that fatigue lifetime will depend not only on stress concentration factor Kt but also on other factors including but not limited to specimen type and dimensions, thickness, method of surface preparation, test frequency and test environment Thus, while the observed fatigue improvements in the invention alloy corresponded to the specific test coupon type and dimensions noted, it is expected that improvements will be observed in other types and sizes of open hole fatigue specimens although the lifetimes and magnitude of the improvement may differ.

In these tests, the invention showed significant improvements in fatigue life with respect to the standard 7055 product. For example, at an applied net section stress of 207 MPa, the invention alloy had a lifetime (based on the log average of all specimens tested at that stress) of 355485 cycles compared to 47692 for the standard 7055 alloy. This represents a seven times (645% improvement) improvement in life which could be utilized to delay the initial inspection interval in an aircraft structure. Conversely, the invention alloy exhibits a significant improvement in the stress level corresponding to a given lifetime. For example, in the invention alloy a lifetime of 100000 cycles corresponds to a maximum net section stress of 224 MPa compared to 190 MPa in the standard 7055 alloy. This represents an improvement of 18% which could be utilized by an aircraft manufacturer to increase design stress of an aircraft, thereby saving weight, while maintaining the same inspection interval for the aircraft.

EXAMPLE 2

Six lots of the invention alloy and seven lots of standard 7055 were cast and fabricated into plate. The actual compositions and plate thickness are shown in Table III.

TABLE III

| Alloy | Lot No. | Temper | Thick (mm) | Si | Fe | Cu | Mg | Zn | Zr |
|---|---|---|---|---|---|---|---|---|---|
| Invention | I | T7951 | 27.2 | 0.029 | 0.039 | 2.10 | 1.88 | 7.83 | .110 |
| | J | T7951 | 27.2 | 0.014 | 0.037 | 2.15 | 1.88 | 7.92 | 0.120 |
| | K | T7951 | 31.8 | 0.018 | 0.032 | 2.09 | 2.00 | 8.19 | 0.107 |
| | L | T7951 | 31.8 | 0.028 | 0.044 | 2.17 | 1.92 | 7.94 | 0.117 |

TABLE III-continued

| Alloy | Lot No. | Temper | Thick (mm) | Si | Fe | Cu | Mg | Zn | Zr |
|---|---|---|---|---|---|---|---|---|---|
| | M | T7951 | 38.1 | 0.018 | 0.032 | 2.09 | 2.00 | 8.19 | 0.107 |
| | N | T7951 | 38.1 | 0.019 | 0.032 | 2.15 | 1.93 | 8.08 | 0.120 |
| Comparison | O | T7951 | 19.0 | 0.079 | 0.122 | 2.31 | 1.89 | 7.99 | 0.120 |
| Alloy | P | T7951 | 19.0 | 0.077 | 0.109 | 2.43 | 1.94 | 8.10 | 0.120 |
| (Standard | Q | T7951 | 25.4 | 0.077 | 0.109 | 2.35 | 1.91 | 8.12 | 0.120 |
| 7055) | R | T7951 | 25.4 | 0.078 | 0.105 | 2.31 | 1.93 | 8.11 | 0.117 |
| | S | T7951 | 31.8 | 0.077 | 0.113 | 2.43 | 1.93 | 8.30 | 0.120 |
| | T | T7951 | 31.8 | 0.074 | 0.116 | 2.44 | 1.93 | 8.15 | 0.120 |
| | U | T7951 | 40.0 | 0.080 | 0.115 | 2.45 | 1.93 | 8.05 | 0.120 |

These plates were solution heat treated, stretched and artificially aged. The aging practice was performed according to the typical thermal cycle described previously for the age forming process. Fatigue testing was performed using a single open hole test coupon having a net stress concentration factor, Kt, of 2.3. The test coupons were 200 mm long by 30 mm wide by 3 mm thick with a single hole 10 mm in diameter. The hole was countersunk to a depth of 0.3 mm on each side. The test coupons were stressed axially with a stress ratio (min load/max load) of R=0.1. The test frequency was 25 Hz and the test were performed in high humidity air (RH>90%). The individual results of these tests are shown in FIG. 2. The lines in the figure are fit to the data using the Box-Cox analysis suitable for statistical analysis of fatigue data.

As in Example 1, the invention alloy exhibited significant improvements in fatigue life with respect to the comparison 7055 products. For example, at an applied net section stress the invention alloy had a mean lifetime (based on the Box-Cox fit) of 415147 cycles representing a 2.4 times (144% improvement) improvement in life compared to the standard 7055 alloy which had a mean lifetime of 170379 cycles. The maximum net section stress at a lifetime of 100000 cycles was 240 MPa in the invention alloy compared to 220 in the standard 7055 alloy, an improvement of 9%. While this improvement is not as great as that previously observed in Example 1, the magnitude of the improvement is expected to vary with differences in specimen design, specimen fabrication procedures and testing conditions, as previously discussed.

EXAMPLE 3

Three lots each of the invention alloy and the standard 7055 alloy were cast and fabricated into plate. The actual compositions and plate thickness are shown in Table 4.

TABLE 4

| Alloy | Lot No. | Temper | Thick (mm) | Si | Fe | Cu | Mg | Zn | Zr |
|---|---|---|---|---|---|---|---|---|---|
| Invention | V | T7751 | 31.7 | 0.020 | 0.030 | 2.15 | 1.89 | 8.05 | 0.130 |
| | W | T7751 | 31.7 | 0.020 | 0.030 | 2.15 | 1.89 | 8.05 | 0.130 |
| | X | T7751 | 31.7 | 0.029 | 0.039 | 2.10 | 1.88 | 7.83 | 0.110 |
| Comparison | Y | T7751 | 31.7 | 0.076 | 0.110 | 2.40 | 1.90 | 7.97 | 0.130 |
| Alloy | Z | T7751 | 31.7 | 0.076 | 0.110 | 2.40 | 1.90 | 7.97 | 0.130 |
| (Standard 7055) | ZZ | T7751 | 19.0 | 0.077 | 0.112 | 2.42 | 1.93 | 8.08 | 0.120 |

These plates were solution heat treated, stretched and aged to the T7751 temper in accordance with U.S. Pat. Nos. 5,108,520 and 5,221,377. Three sets of low-load transfer joint fatigue specimens were fabricated from these lots using a reverse double dog-bone design shown schematically in FIG. 3. This design is comprised of two dog-bone (i.e., a reduced width test section in the middle between two wider ends for gripping) details joined in the test section by two aerospace fasteners. Low-load transfer indicates that only a small percentage of the applied load (roughly 5%) is transferred through the fastener. This is accomplished by offsetting the reduced section of the two dog-bones in the joined assembly. The remainder of the load bypasses the fastener and is carried through the test section area by the two dog-bone specimens. This specimen is representative of a skin to stringer attachment such as that found in the upper or lower wing cover of a commercial aircraft.

The first set of low-load transfer joints fabricated from Invention Lot V and Comparison Lot Y consisted of two dog-bone details having a width in the reduced section of 25.4 mm and a thickness of 8 mm. The length of the reduced section was 70 mm while the overall length of the specimen (i.e., including grip ends) was 455 mm. Prior to assembly, the dog-bone details were chromic acid anodized and primed with zinc chromate primer. The two fastener holes were drilled and reamed to a final diameter of 0.2465 inch. The hole pitch was 25.4 mm. One side of one hole in each detail was countersunk using a 100° countersink tool to accommodate the fastener head. Aerospace quality fuel tank sealant was spread on the faying surfaces of the dogbone details. The two details were then joined with two 0.250 inch diameter interference fit fasteners having a nominal interference of 0.0025 inch. The fasteners were Ti pin HST755KN and steel nut NSA 5474. The nuts were torqued to 60–70 in-lbs. Five specimens of the invention alloy and five of the standard 7055 alloy were tested at a mean stress of −60 MPa and an alternating stress of +155 MPa. The test environment was lab air having a relative humidity of 35 to 52% and the test frequency was 18 Hz. The results of these tests are given in FIG. 4. The line between the results from the two alloys connects the mean of the invention alloy and the comparison alloy. The invention alloy had an average lifetime of 211141 cycles compared to 134176 for the standard 7055 alloy, an increase in life of about 1.5 times or an improvement of 57%.

The second set of low-load transfer joints fabricated from Invention Lot W and Comparison Lot Z consisted of two dogbone details having a width in the reduced section of 31.7 mm and a thickness of 6.35 mm. The length of the reduced section was 76.2 mm while the overall length of the specimen (i.e., including grip ends) was 355 mm. The fastener hole pitch was 31.75 mm. The remainder of the fabrication and assembly details were essentially the same as Set 1 except the fasteners. In Set 2, the fasteners were steel pin HL19B and aluminum collar HL70. Seven specimens of the invention alloy and seven of the standard 7055 alloy were tested at mean stress of +102.4 MPa and an alternating stress of ±83.8 MPa. The test environment was high humidity air having a relative humidity greater than 90% and the test frequency was 11 Hz. The results of these tests are given in FIG. 5. The invention alloy had an average lifetime of 551701 cycles compared to 210824 for the standard 7055 alloy, an increase in life of 2.6 times or an improvement of 162%.

The third set of low-load transfer joints fabricated from Invention Lot X and Comparison Lot Z were of the same dimensions as the second set and their fabrication and their fabrication and assembly were essentially the same as Sets 1 and 2 except for the fasteners. In Set 3, the fasteners were Ti pin HST755 and aluminum nut KFN 587. Four specimens of the invention alloy and six of the standard 7055 alloy were tested at mean stress of −60 MPa and an alternating stress of ±155 MPa. The test environment was high humidity air having a relative humidity greater than 90% and the test frequency was 18 Hz. The results of these tests are given in FIG. 6. The invention alloy had an average lifetime of 445866 cycles compared to 217572 for the standard 7055 alloy, an increase in life of about 2 times or an improvement of 105%.

The observed improvement in life in a low-load transfer joint ranged from 57% to 162%. Joint fatigue specimens are used in the aircraft industry to estimate material performance in typical aircraft structural joints. In the case of low-load transfer joints, they are intended to represent a skin-stringer detail of a wing panel. However, those skilled in the art appreciate that fatigue lifetime will depend on joint type, joint design, fabrication and assembly details, fastener type, as well as loading parameters and testing environment. Thus, while the observed fatigue improvements in the invention alloy corresponded to the specific joint designs, fabrication method, fastener type and testing parameters utilized, it is expected that improvements will be observed in other types of joint designs although the lifetimes and magnitude of the improvement may differ.

Having described the presently preferred embodiments, it is to be understood that the invention may be otherwise embodied within the scope of the appended claims.

What is claimed is:

1. An improved aluminum alloy product having about, by weight, 7.6 to about 8.4% zinc, about 2.0 to about 2.5% copper, about 1.8 to about 2.3% magnesium, about 0.088 to about 0.25% zirconium, the balance to 100 weight % substantially aluminum and incidental elements and impurities, the improvement comprising maintaining the weight percents of iron and silicon to about 0.01 to about 0.09% iron, and about 0.01 to about 0.06% silicon.

2. The improved alloy product of claim 1, wherein said product is a plate, sheet, extrusion, forging or casting.

3. An improved AA 7XXX series alloy product suitable for aerospace applications having improved fatigue failure resistance, said alloy comprising about, by weight, 7.6 to about 8.4% zinc, about 2.0 to about 2.6% copper, about 1.8 to about 2.3% magnesium, about 0.088 to about 0.25% Zr the balance to weight % substantially aluminum and incidental elements and impurities, the improvement comprising lowering the amount of Fe to about 0.01 to about 0.09%, and the amount of Si to about 0.01 to about 0.06%.

4. The improved alloy product of claim 3, wherein said product is a plate, sheet, extrusion, forging or casting.

5. The improved alloy product of claim 2 which is a plate suitable for use as an upper wing member.

6. The improved alloy product of claim 1 which has been solution heat treated, stress relieved via plastic deformation, and artificially aged.

7. An improved alloy extrusion having a cross-section including a thickness less than about 3 inches having a composition including about, by weight, 7.6 to about 8.4% zinc, about 2.0 to about 2.6% copper, about 1.8 to about 2.3% magnesium, about 0,088 to about 0.25% Zr the balance to weight % substantially aluminum and incidental elements and impurities, the improvement comprising, wherein the alloy further comprises 0.01 to 0.09 wt. % Fe and 0.01 to 0.06 wt. % Si.

* * * * *